US009955722B2

(12) United States Patent
Reyes et al.

(10) Patent No.: US 9,955,722 B2
(45) Date of Patent: May 1, 2018

(54) DRY HERB AND ORGANIC MATERIAL WATER PIPE BODY

(71) Applicants: Hari Mark Reyes, Portland, OR (US); Phillip John Fraser, La Center, WA (US)

(72) Inventors: Hari Mark Reyes, Portland, OR (US); Phillip John Fraser, La Center, WA (US)

( * ) Notice: Subject to any disclaimer, the term of this patent is extended or adjusted under 35 U.S.C. 154(b) by 295 days.

(21) Appl. No.: 14/837,860

(22) Filed: Aug. 27, 2015

(65) Prior Publication Data

US 2017/0055571 A1 Mar. 2, 2017

(51) Int. Cl.

| | |
|---|---|
| ***A24B 3/14*** | (2006.01) |
| ***A24F 1/32*** | (2006.01) |
| ***A24F 1/30*** | (2006.01) |
| ***A24F 5/00*** | (2006.01) |

(52) U.S. Cl.

CPC ..... *A24F 1/32* (2013.01); *A24F 1/30* (2013.01); *A24F 5/00* (2013.01)

(58) Field of Classification Search

CPC ..... A24F 1/30; A24F 1/32
USPC ..... 131/173, 378
See application file for complete search history.

(56) References Cited

U.S. PATENT DOCUMENTS

| | | | | |
|---|---|---|---|---|
| 4,036,240 A * | 7/1977 | Murray, Jr. | A24F 1/30 | 131/173 |
| 4,111,214 A * | 9/1978 | Flesher | A24F 1/30 | 131/173 |
| 4,682,610 A * | 7/1987 | Freelain | A24F 1/30 | 131/173 |
| 8,434,494 B1 * | 5/2013 | Gonzalez | A24F 1/30 | 131/173 |
| 2009/0084391 A1 * | 4/2009 | Krupp | A24F 1/30 | 131/173 |
| 2013/0032159 A1 * | 2/2013 | Capuano | A24F 47/008 | 131/329 |

* cited by examiner

*Primary Examiner* — Nina Bhat
(74) *Attorney, Agent, or Firm* — Mark S. Hubert

(57) ABSTRACT

A portable, dishwasher safe, dry herb water pipe body capable of connection to a plethora of different fluid vessels. It has a flexible polymer bidirectional flow connector that facilitates the flow of smoke from and into the water pipe body. This flow connector also frictionally engages the neck of a bottle, jar or can, thereby sealing the fluid vessel to the body of the water pipe, completing its functionality. Ice can be placed in the water pipe to further cool the incoming smoke charge for the user. After use, if a disposable fluid vessel and fluid were used, the water pipe body can be removed and no further storage or cleaning action is required. With the optional plug, the device can be used in a dry smoke mode or fluid can be added into the plug for a shortened version of a water pipe.

10 Claims, 17 Drawing Sheets

2A

A

DRY HERB AND ORGANIC MATERIAL WATER PIPE BODY

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

The present invention relates to a portable water pipe for smoking dry herbs. I can be used in three different modes.

Dry herb smoke enthusiasts commonly use water pipes to enjoy their favorite herb. There are several problems with such devices and their use. First, is that they are generally made of glass, and are fragile. Second, they are permanently connected to a specific water vessel. Third, the water vessel is problematic to clean and the herb residue in the water has an odor that is difficult to wash off. Fourth, with their water vessel attached they are large and not portable, hence the reason for dedicated locations to use the water pipe such as personal residences, hookah bars, etc.

Smoking has seen an upswing in current years, much of it due to the new electronic cigarettes and the revival of hookah bars. More than ever, the American public wants to be able to enjoy their smoking anywhere. Henceforth, a portable, rugged water pipe that did not require a dedicated bowl and minimized the water vessel cleaning process would fulfill a long felt need in the dry herb smoking industry. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide a rugged, portable, compact, water pipe body that can connect to a plethora of fluid vessels, disposable or otherwise, and eliminates the need to reuse or clean the fluid vessel.

It has many of the advantages mentioned heretofore and many novel features that result in a new dry herb water pipe which is not anticipated, rendered obvious, suggested, or even implied by any of the prior art, either alone or in any combination thereof.

In accordance with the invention, an object of the present invention is to provide an improved dry herb water pipe capable of simplified connection to the majority of commercially available bottles and fluid vessels including but not limited to beer bottles, pop bottles, wine bottles, alcohol bottles and the like.

It is another object of this invention to provide a lightweight, polymer water pipe capable of direct fresh air induction and optional ice cooling of the incoming smoke charge.

It is an additional object of this invention to provide a dishwasher safe water pipe capable of being cleaned in a dishwasher.

It is a further object of this invention to provide an improved portable water pipe with a minimal number of structural components to reduce the cost of fabrication.

It is a still another object to provide an aesthetically appealing water pipe. It is a last object of this invention to provide a water pipe body capable of being used in a vessel mode, a dry plug mode and a wet plug mode.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
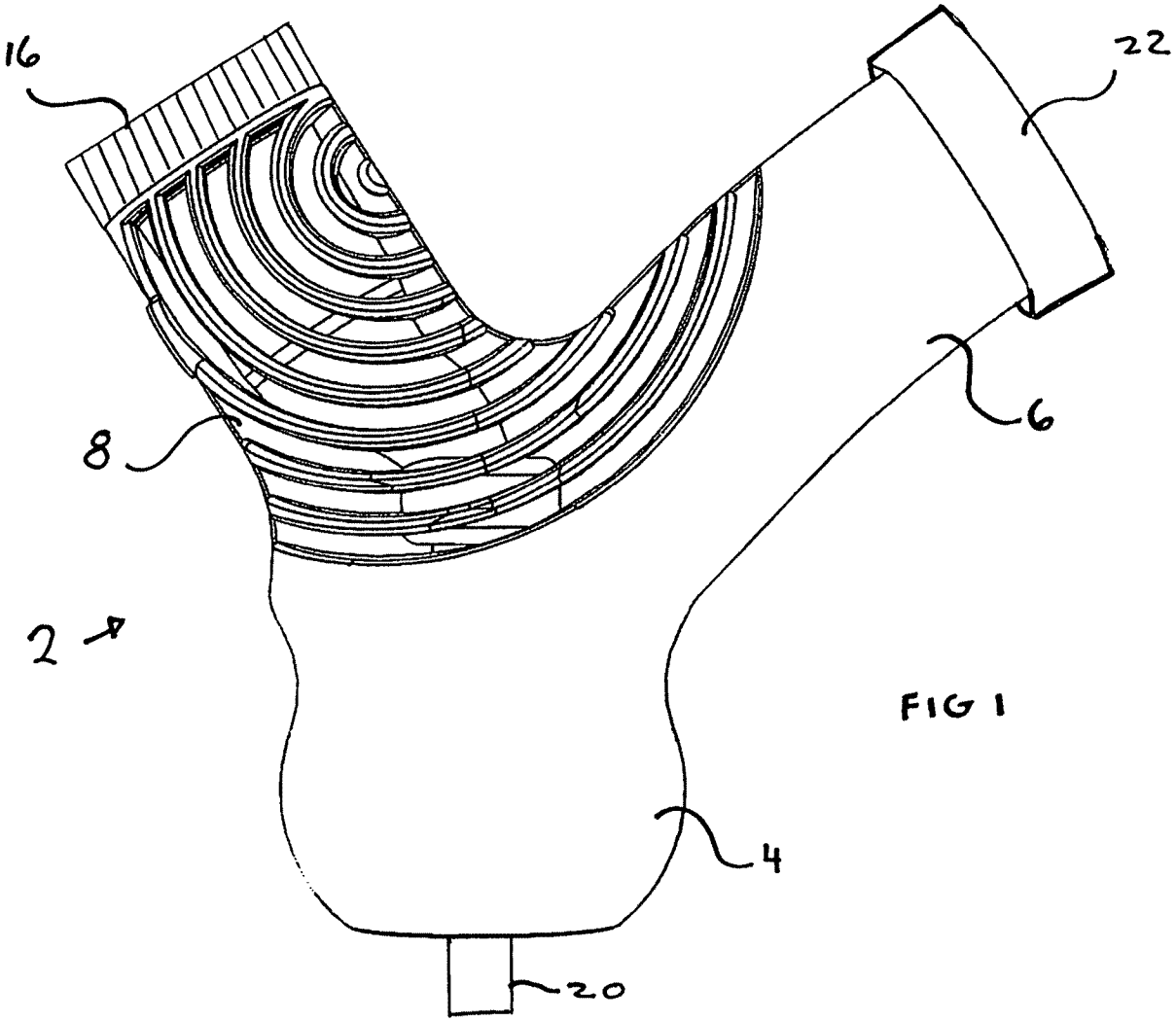
FIG. 1 is a side view of the water pipe body with all components thereon.
Figure 2:
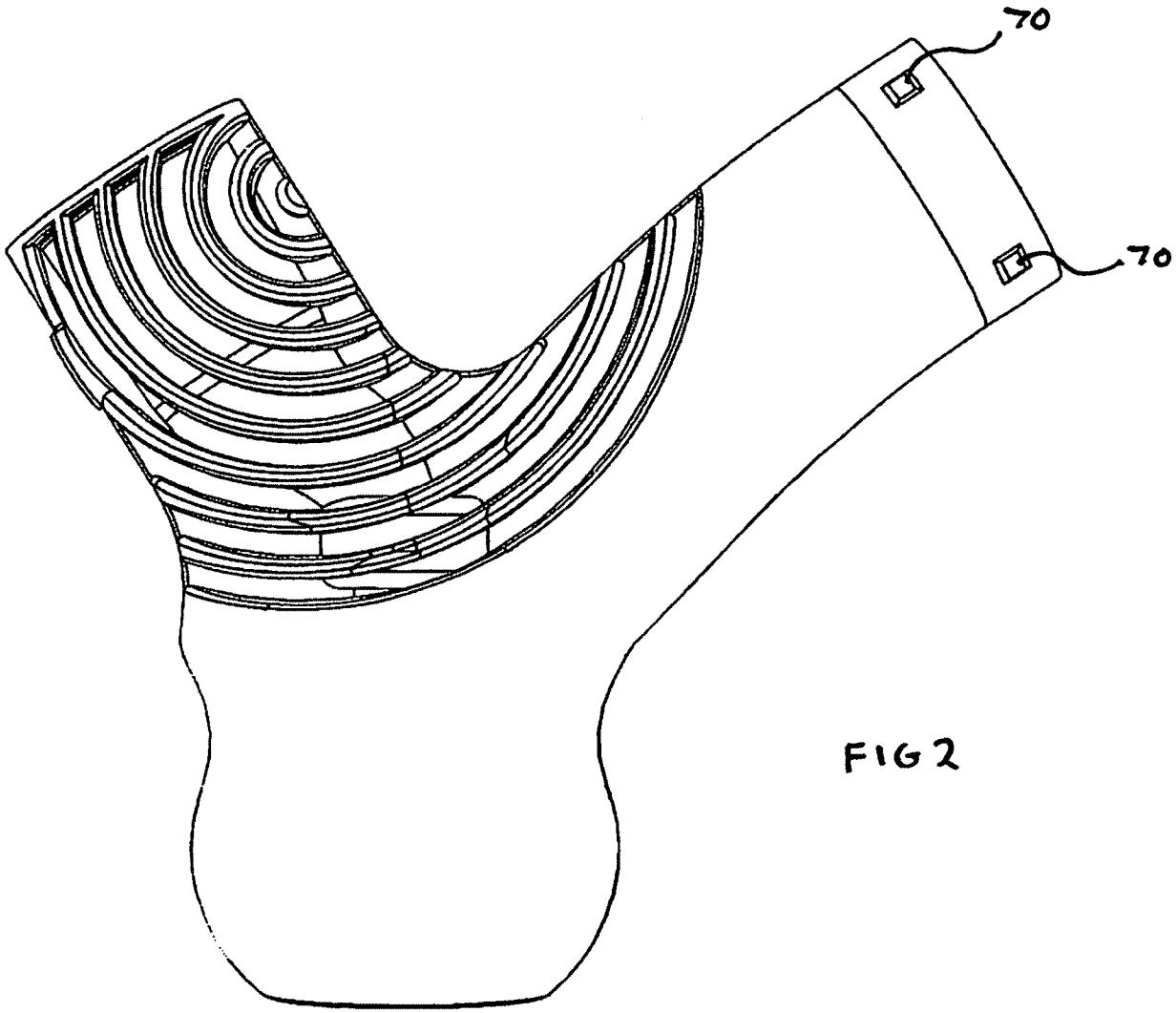
FIG. 2 is a side view of the water pipe body housing.
Figure 3:
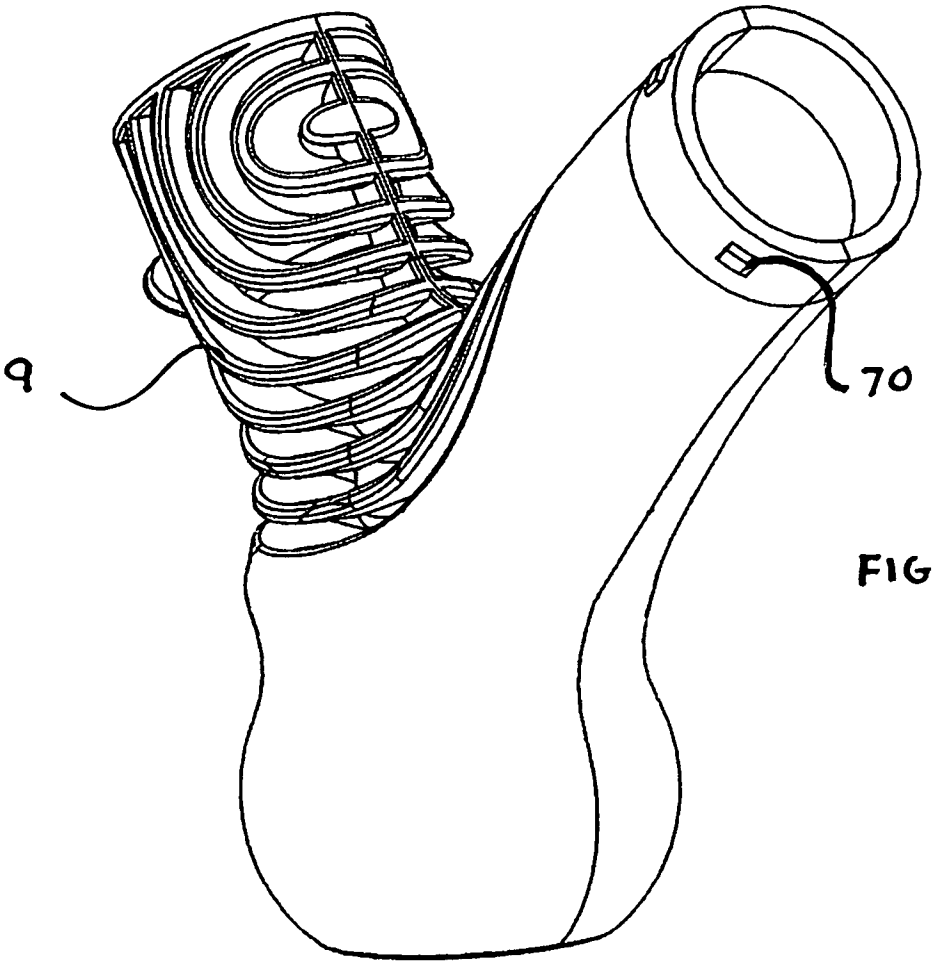
FIG. 3 is a perspective front view of the water pipe body housing.
Figure 4:
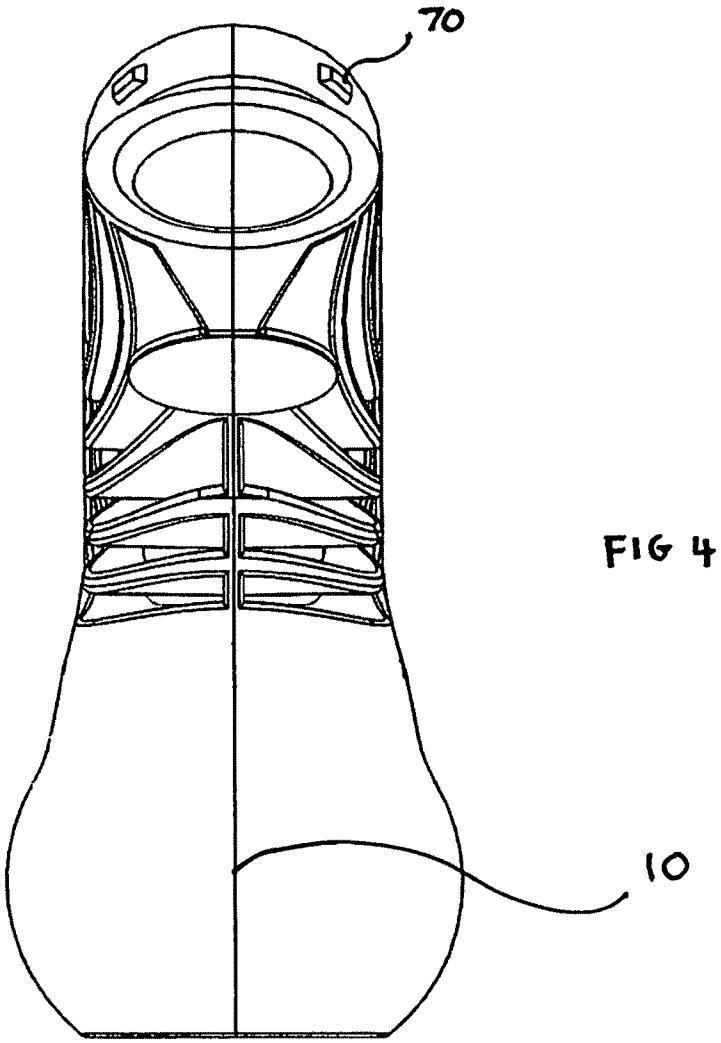
FIG. 4 is a rear view of the water pipe body housing.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

The present invention relates to a water pipe body that can be made into an operational water pipe by the frictional attachment to a fluid vessel such as a beer bottle, water bottle, wine bottle, soda bottle, liquor bottle and the like. The water pipe is for the smoking of dry herbs or organic material thereon/therein. It is known that the fluid vessels in the form of cans or wide mouth bottles may also be frictionally attached. With this portability a user could secure the fluid filled vessel of their choice, frictionally attach the water pipe body to the open top of the vessel, fill the bowl insert 16 with a dry herb, ignite and smoke the dry herb then just toss away the vessel and its fluid contents.

Looking at FIGS. 1-4, the side view (assembled), housing side view, housing front perspective view and housing rear view, the water pipe body 2 is best understood. It can be seen that the waterpipe body 2 has a generally "Vee" shaped configuration branching upward from the bulbous connection base 4. There are several contours on the exterior surface thereof that are both aesthetically appealing and ergonomic for holding. The longer of the two tubular tails of the Vee is the inhalation arm 6 and the shorter of the two tails is the bowl arm 8. The bowl arm 8 has a series of circular outwardly ribs 9 formed on its exterior surface. These ribs help dissipate any heat accumulated in the bowl arm 8 during extended use. The material of construction in the preferred embodiment is a dishwasher safe polycarbonate but a polymer with or without modifying materials such as fiberglass, carbon fiber etc., may also be used. It is to be noted that there is a vertical seam 10 that runs along the plane of the axial centerline of the water pipe body 2. This exists because the water pipe body 2 is fabricated in two halves sectioned about the longitudinal axis of the body, for the reason of lowering fabrication costs (a longitudinally split body).

Figure 7:
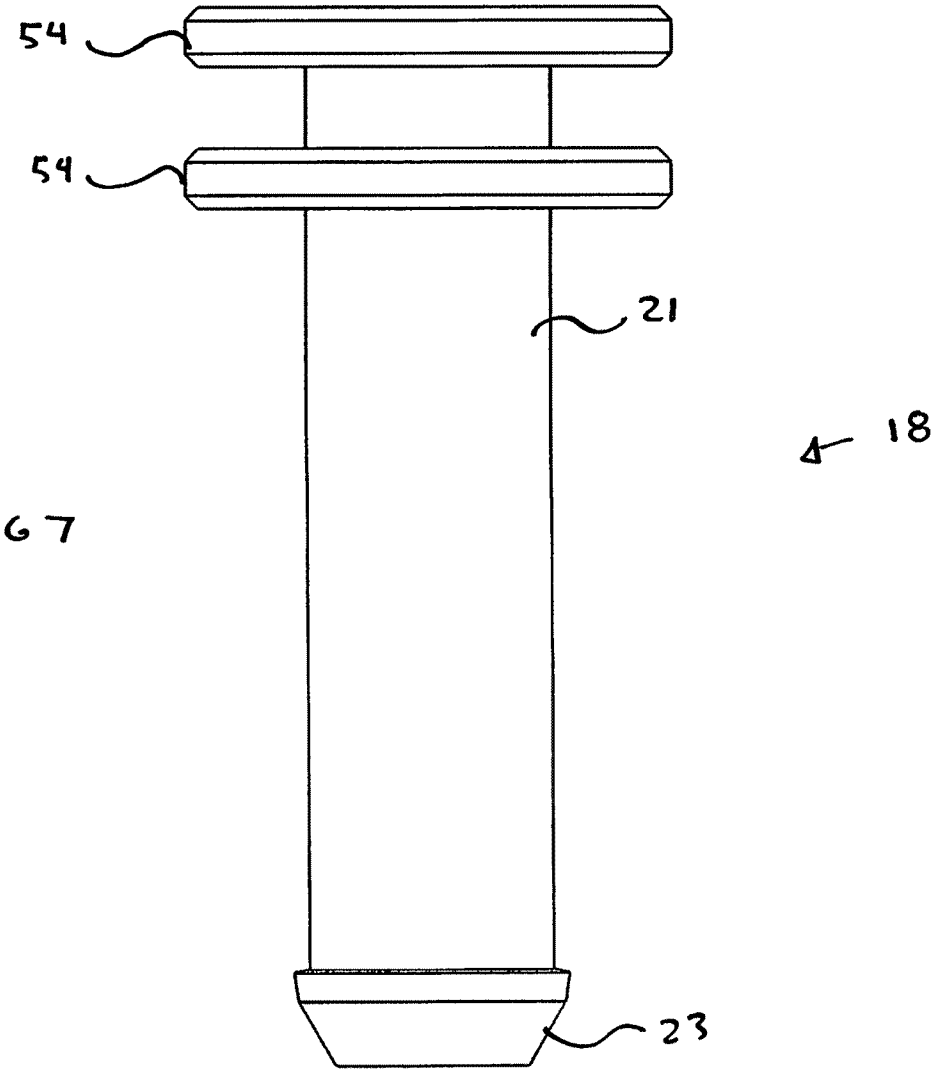
FIG. 7 is a side view of the straw connector.
Figure 8:
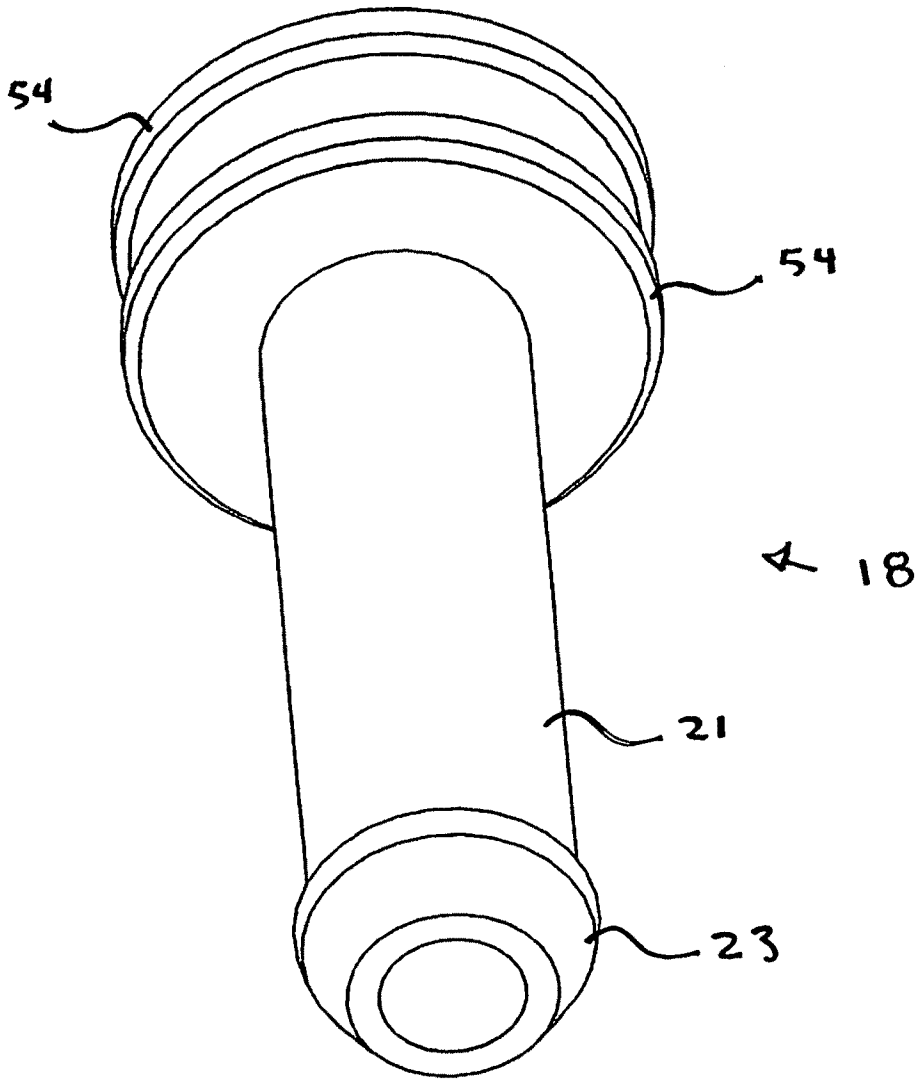
FIG. 8 is a perspective illustrative view of the straw connector.
Figure 10:
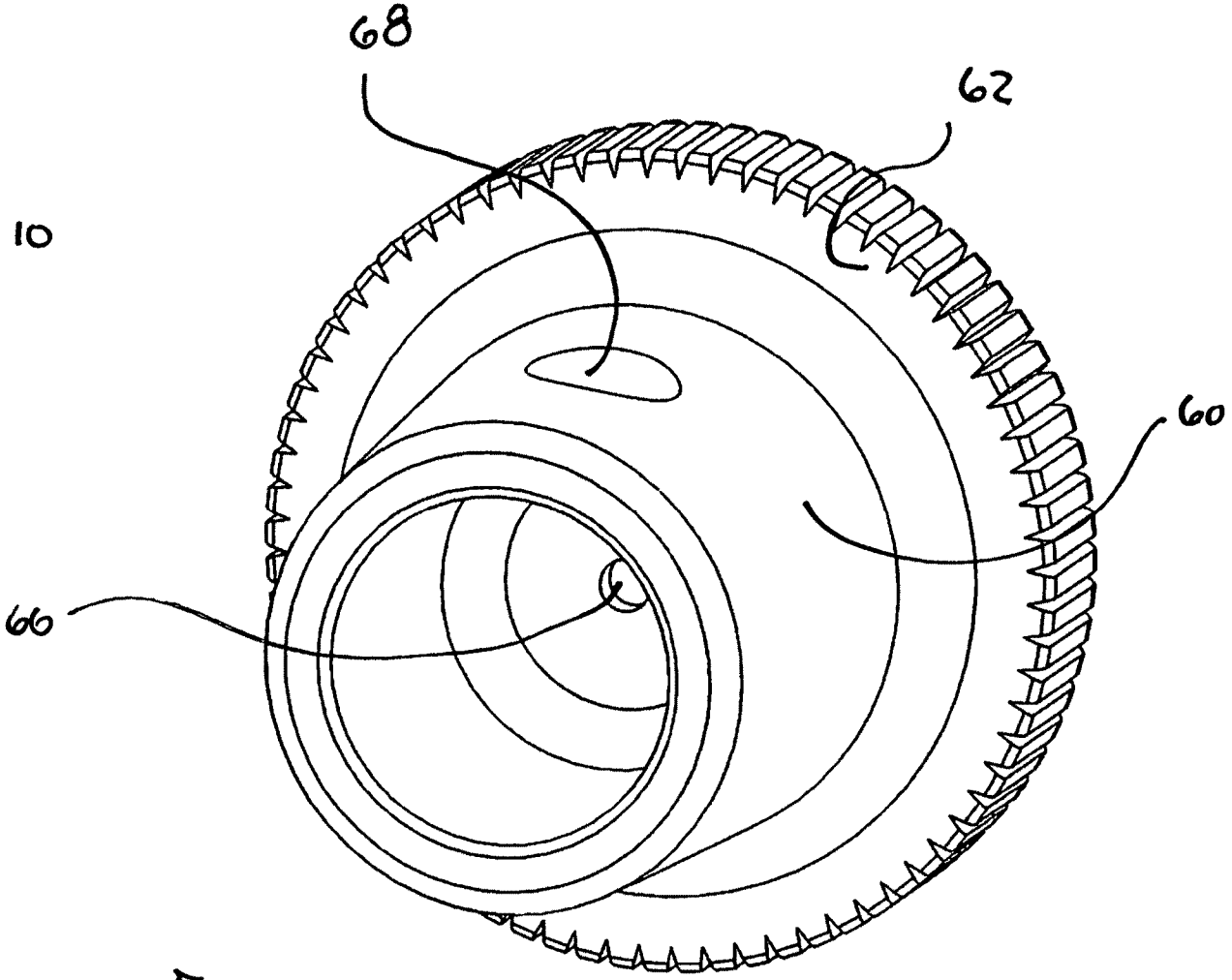
FIG. 10 is a bottom perspective view of the bowl insert.
Figure 11:
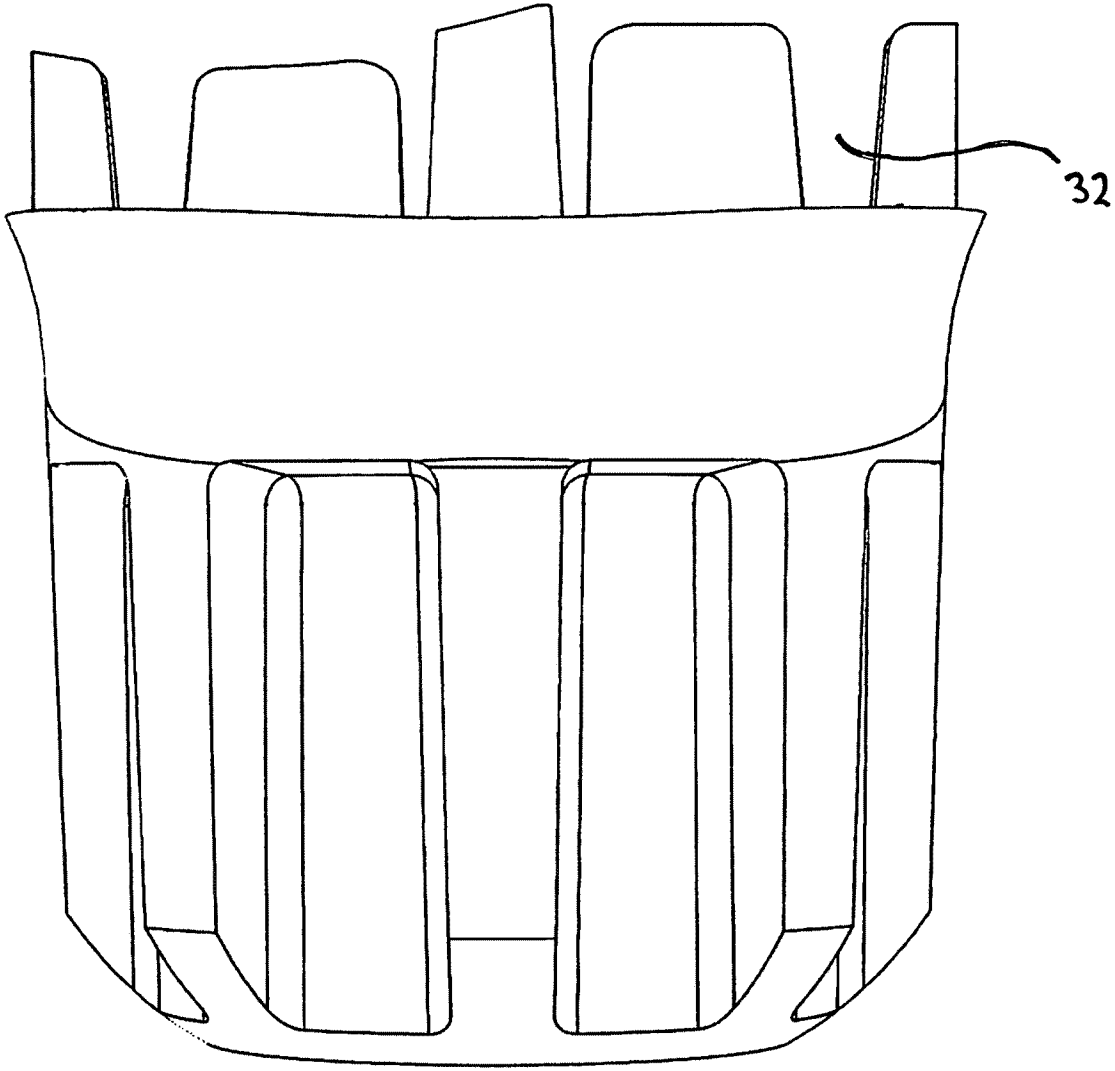
FIG. 11 is a side view of the bidirectional flow connector insert.
Figure 12:
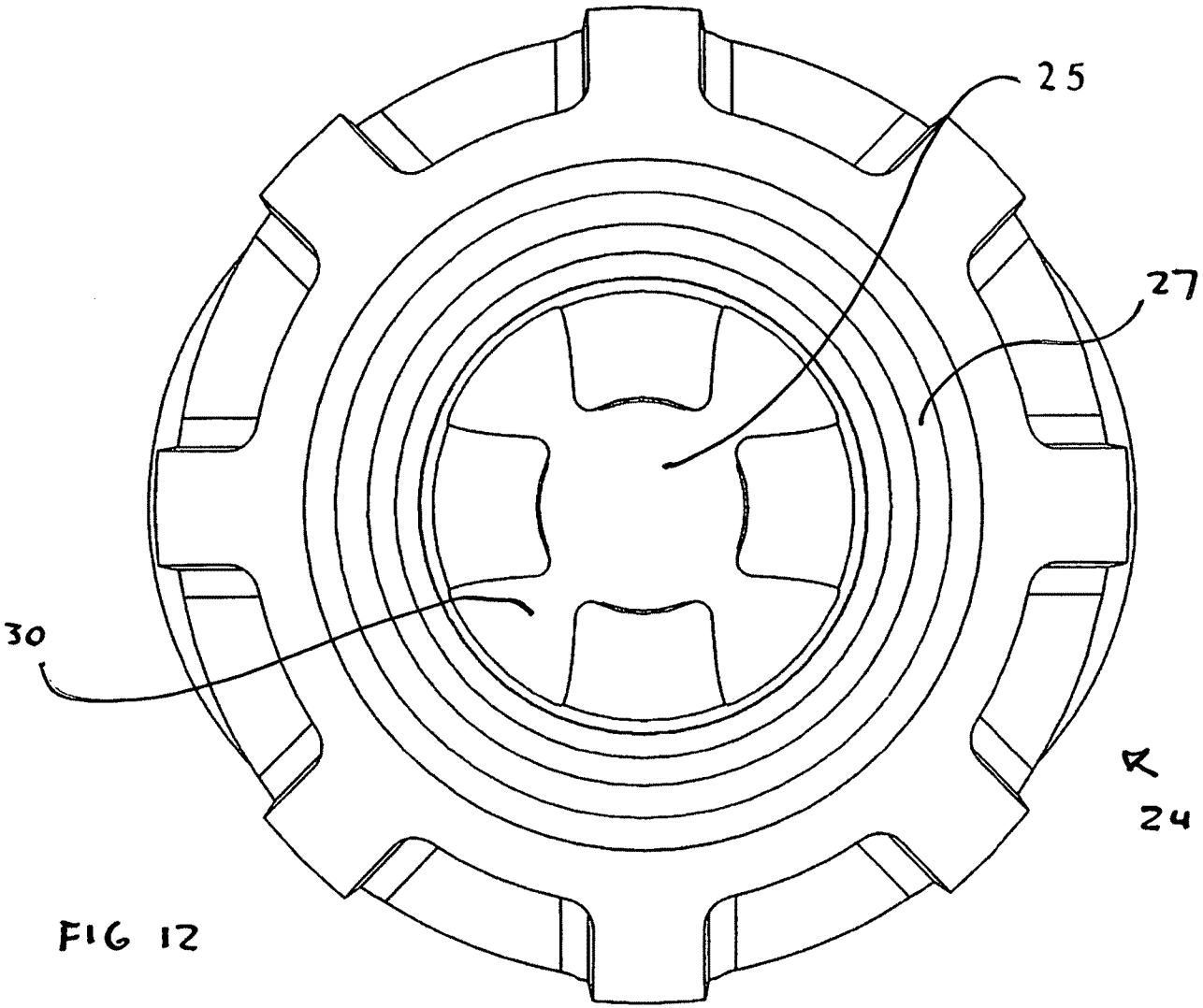
FIG. 12 is a bottom view of the bidirectional flow connector insert.
Figure 13:
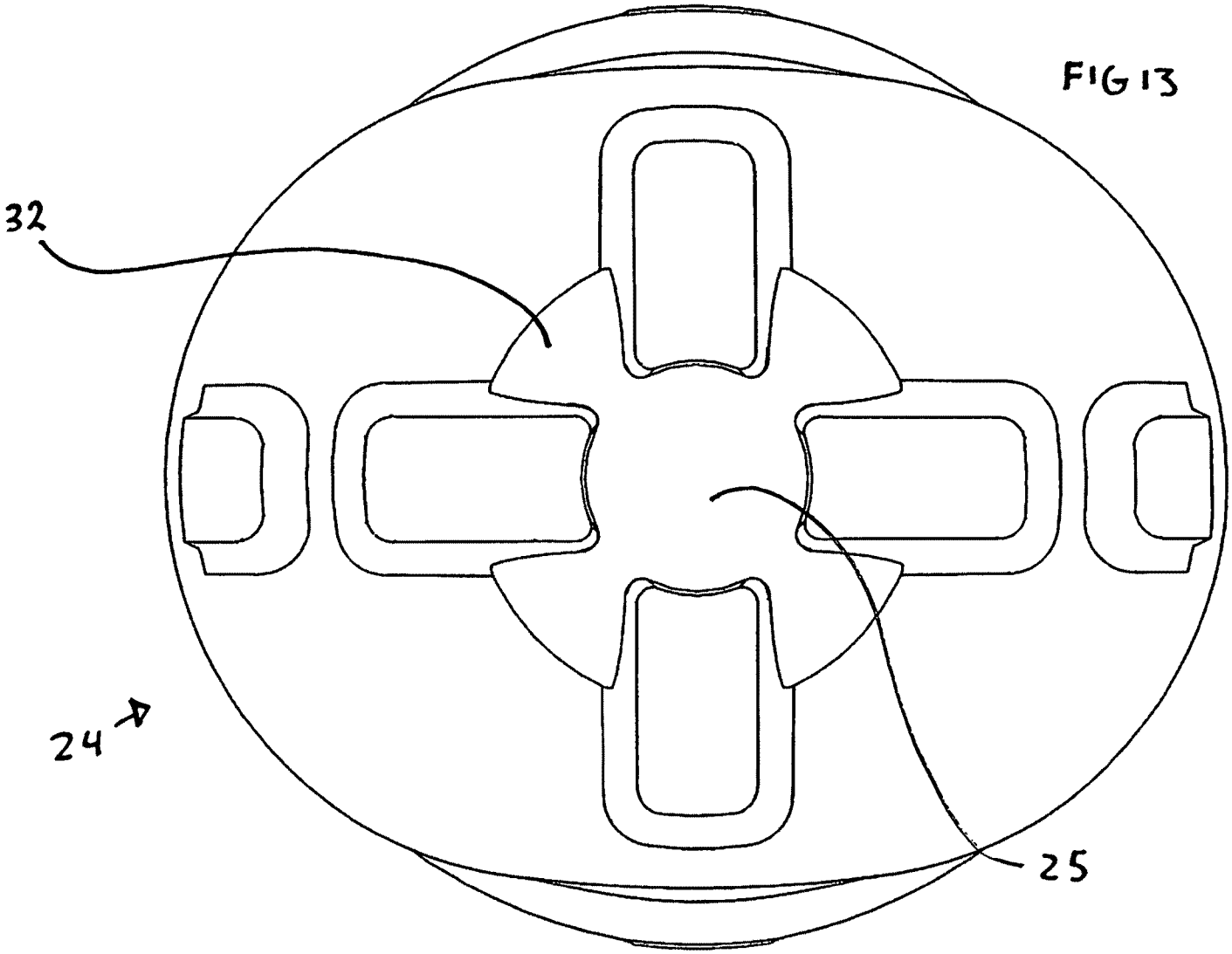
FIG. 13 is a top view of the bidirectional flow connector insert.

The water pipe body is made of seven components; a body right half housing 12 (FIG. 5) and a body left half housing 14 (FIG. 6); a removable tapered bowl insert 16 (FIGS. 9 and 10), a straw connector 18 (FIGS. 7 and 8), a straw 20 (FIG. 1), an optional mouthpiece ring 22 (FIGS. 14 and 15), and a bidirectional flow connector insert 24 (FIGS. 11, 12 and 13).

Figure 5:
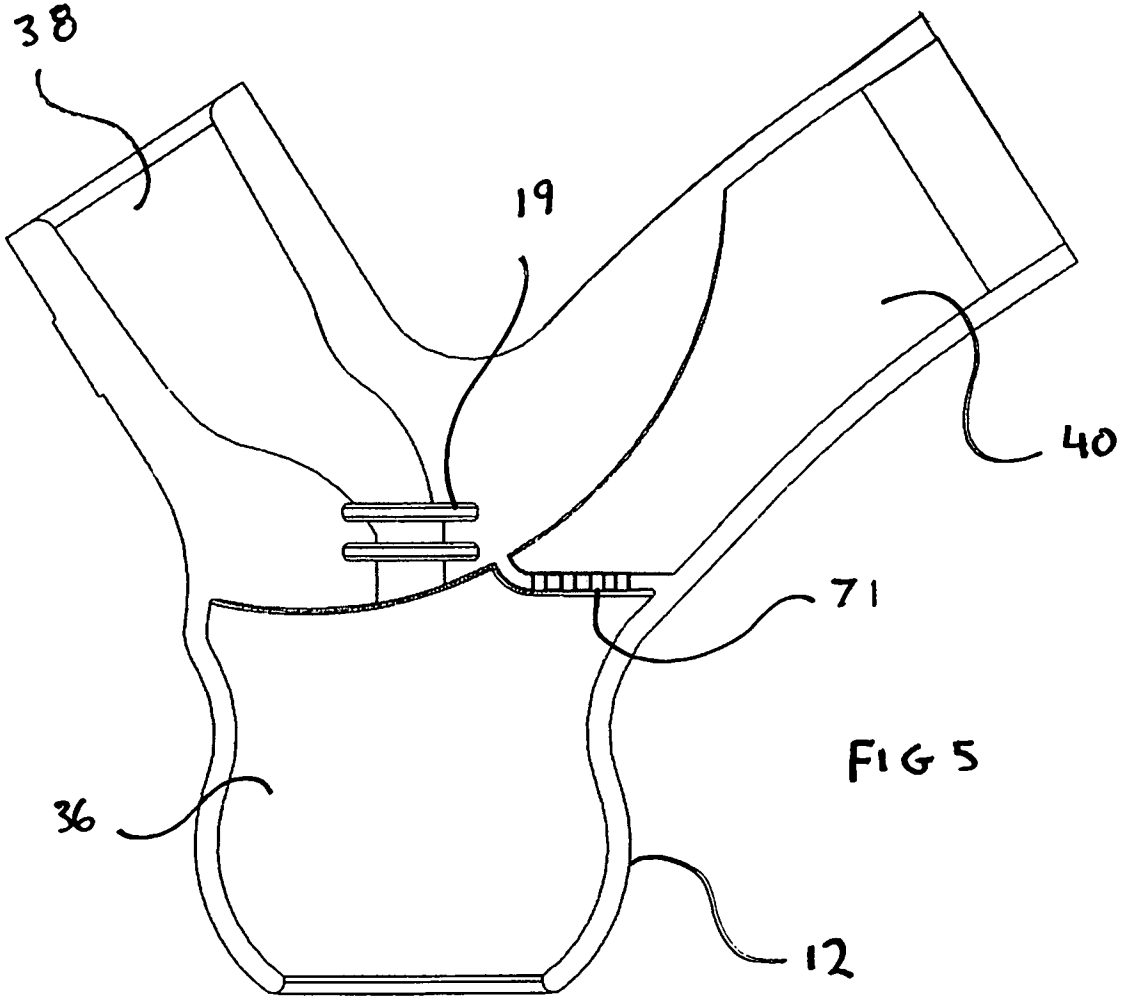
FIG. 5 is a side view of the water pipe body housing right half.
Figure 6:
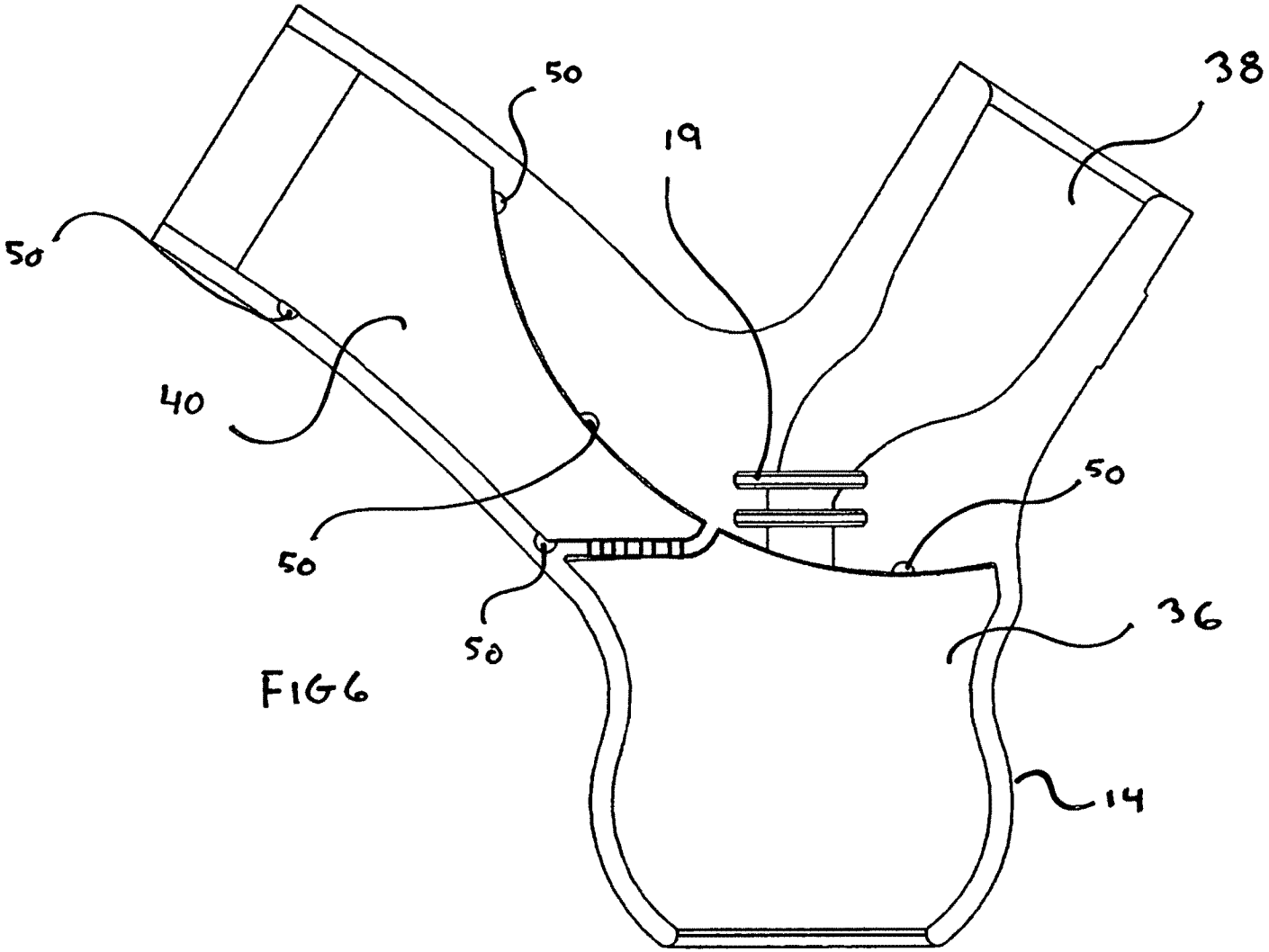
FIG. 6 is a side view of the water pipe body housing left half.

Looking at FIGS. 5 and 6, side views of water pipe body right half housing 12 (FIG. 5) and left half housing 14 FIG. 6), it can be seen that each of these is a mirror image of the other, with each representing one half of the water piper body's assembled housing. These, when assembled, define an upper chamber 38, a lower chamber 36 and a side chamber 40. They each have identical detents 19 for receiving a straw connector 18, and their lower chambers 36 are sized for the frictional retention of the bidirectional flow connector insert 24. These two parts are inserted into either of the body halves and the other body half is matingly assembled before the two body halves are ultrasonically welded at weld points 50 (FIG. 6) below the surface, and along the outer edge of the water pipe body 2. A vertical seam 10 is visible after assembly. In the lower half of the side chamber 40 of the water pipe body 2 is a series of small slots that form a grate-like structure 71 to house ice chips.

Figure 9:
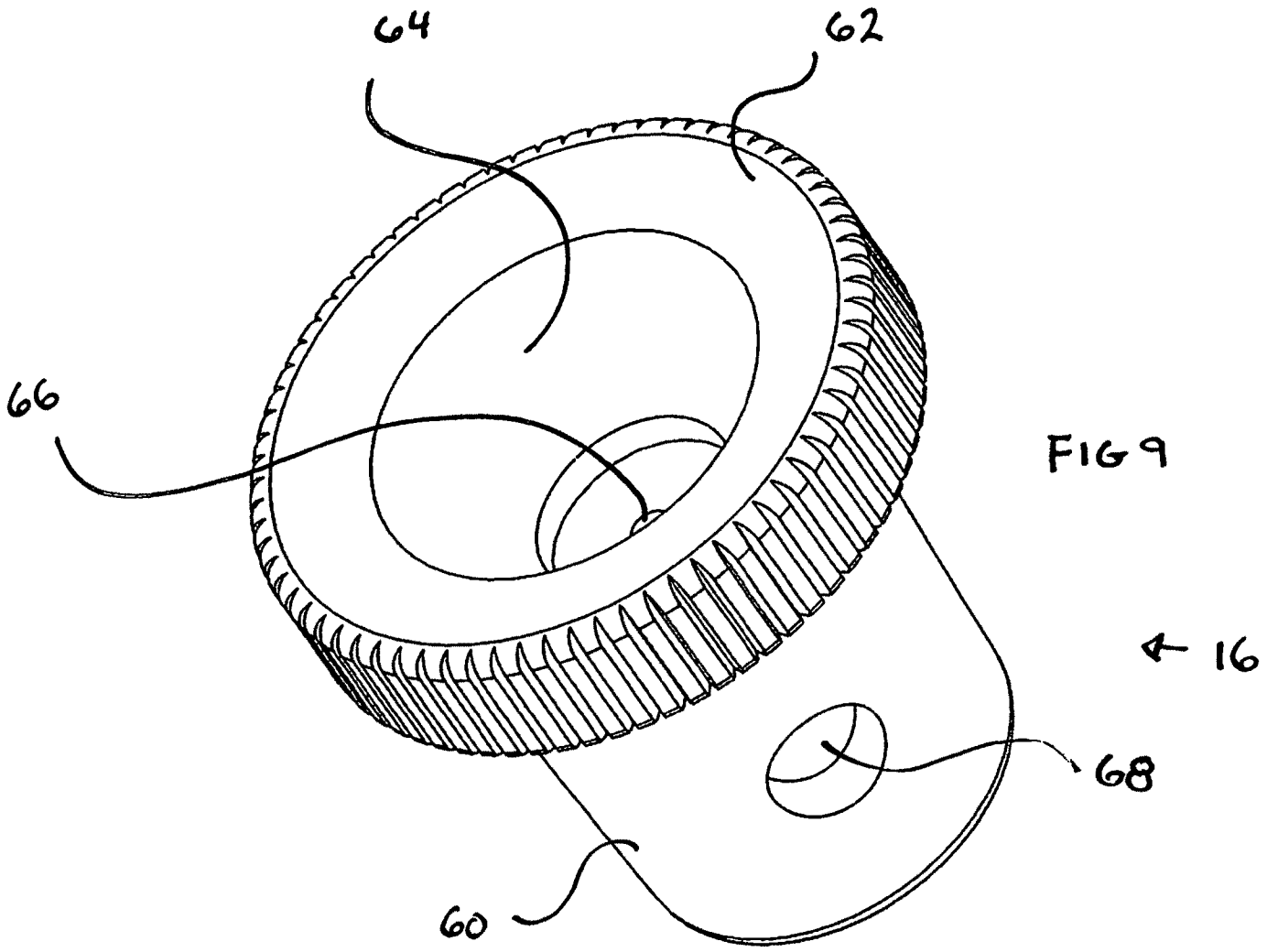
FIG. 9 is a top perspective view of the bowl insert.

The bowl insert 16 can best be seen looking at FIGS. 9 and 10. It has a tapered sleeve 60 affixed to the bottom end of a ring 62 with a centrally formed concave depression 64 having a smoke orifice 66 at the bottom thereof. There is a fresh air induction port 68 through the side of the tapered sleeve 60. The tapered sleeve 60 is sized for frictional engagement with the upper chamber's inner wall. In the preferred embodiment, the bowl insert is made of machined aluminum with a hard anodized surface treatment to increase strength and temperature resistance. It is dishwasher safe.

The straw connector 18 is a tube 21 with a radiused bottom flange tip 23 and a pair of identical locking flanges 54 at its top. The flanges 54 lock the straw connector 18 into the two slots 19 formed centrally in the water pipe body's left and right housings 12 and 14 so as to align the straw connector 18 down the center of the bidirectional flow connector insert 24. In the preferred embodiment it is made of machined aluminum that is dishwasher safe. The straw 20 is but a polymer tube made of a dishwasher safe material that depending upon its size, may be affixed frictionally on the outside of the straw connector 21 or on the inside of the straw connector 21.

Figure 14:
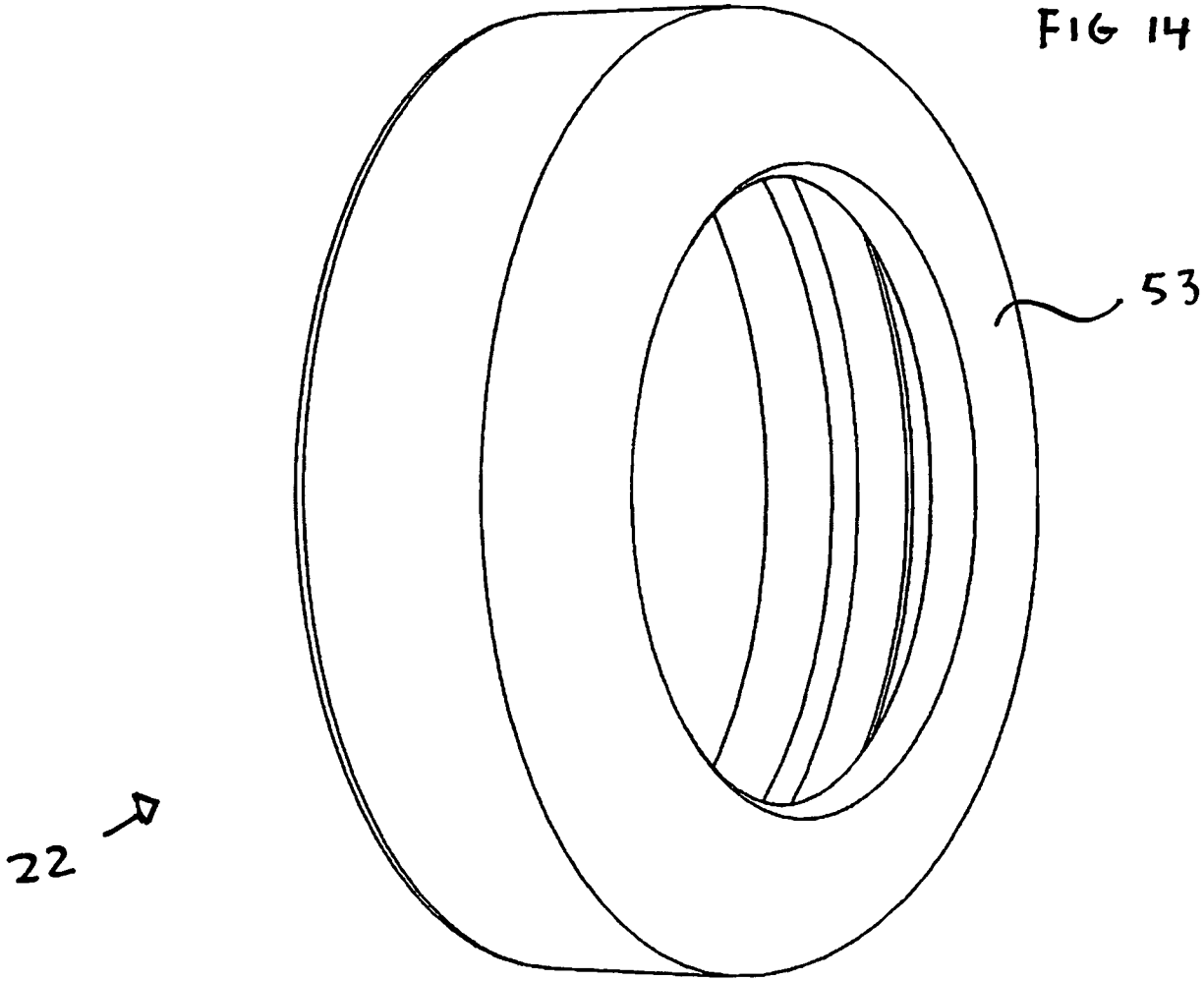
FIG. 14 is a front perspective view of the mouthpiece.
Figure 15:
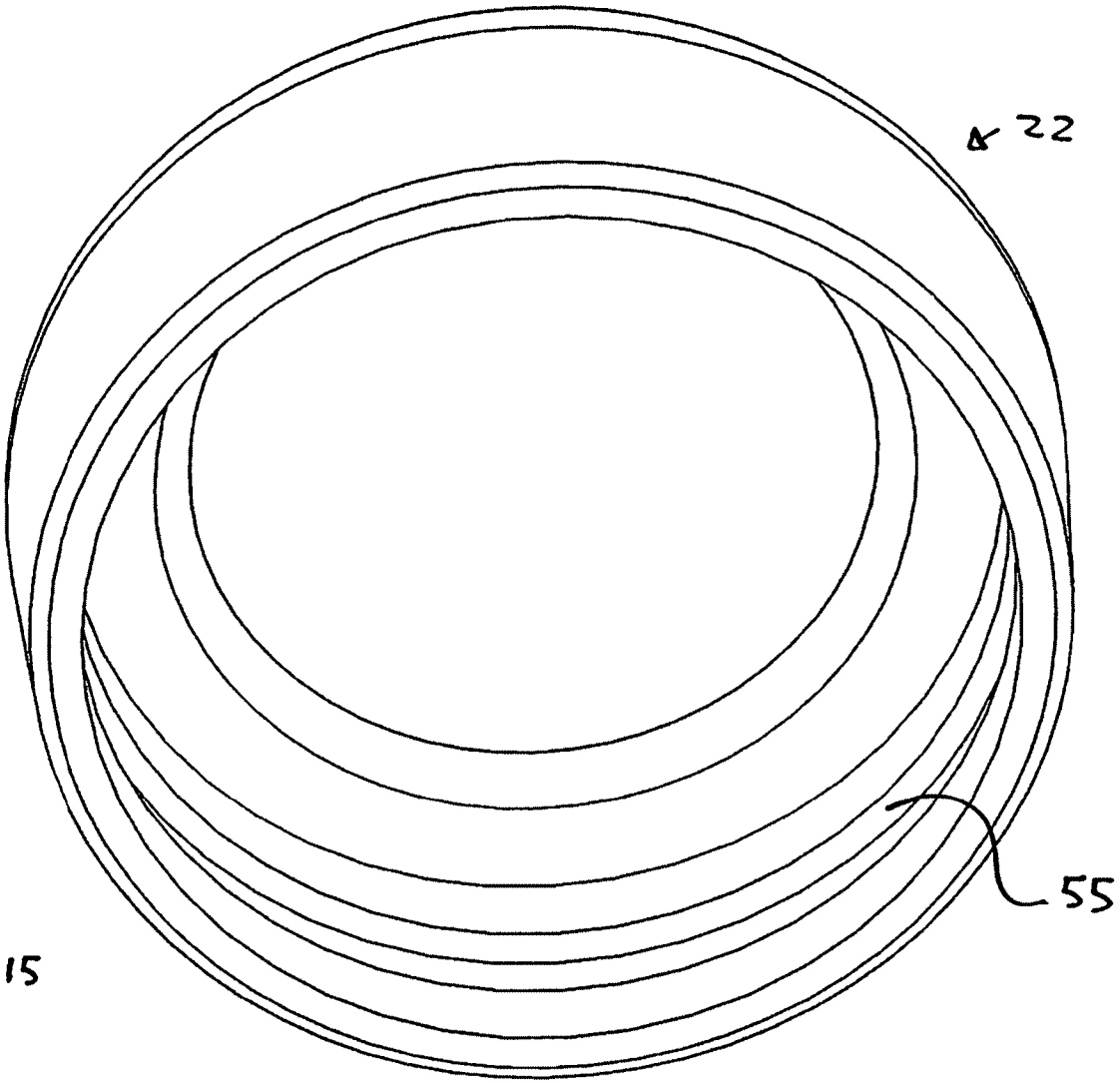
FIG. 15 is a rear perspective view of the mouthpiece.
Figure 16:
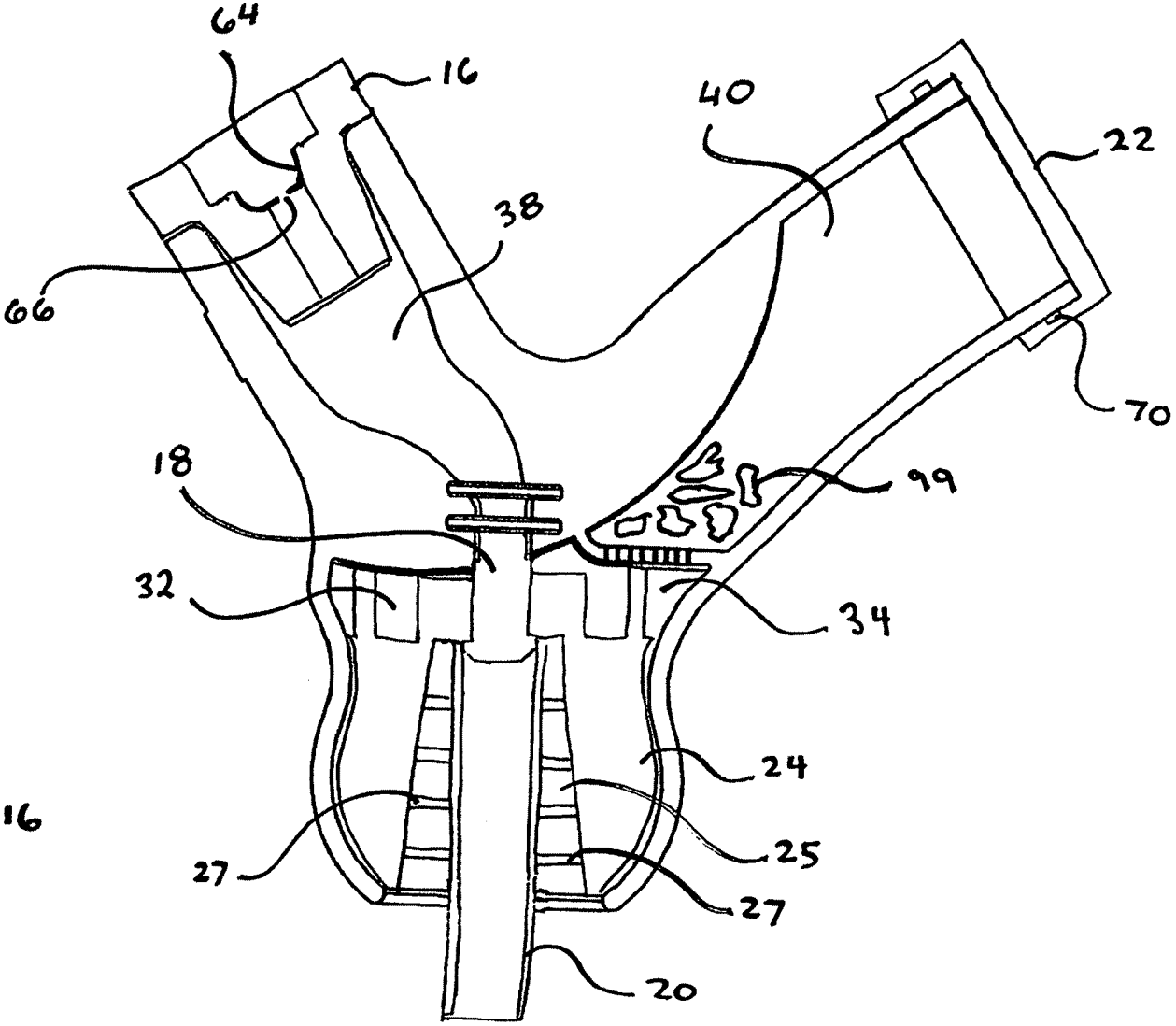
FIG. 16 is a side cross sectional view of the assembled water pipe body.

The mouthpiece ring 22 as seen in FIGS. 14 and 15 is a machined aluminum ring sized for frictional engagement over the raised protrusions 70 (FIG. 2) about the outer periphery of the tip of the inhalation arm 6 (FIG. 1). It is dishwasher safe. Its outer face 53 (FIG. 14) has a slight radius, and the inner face has a groove 55 about its perimeter that secures the ring 22 over the protrusions 70.

The bidirectional flow connector insert 24 is made of a flexible thermoplastic elastomer that is dishwasher safe. It has a central bore 25 that accommodates the straw connector 18 in its center and a series of side vents 32 that extend radially from the center 30. The side vents 32 exit into the smoke return cavity 34 in the water pipe body. The smoke return cavity 34 is formed in the lower chamber 36 between the seal formed at the perimeter of the bidirectional flow connector insert 24 and the inner wall of the water pipe valve's lower chamber 36. The bidirectional flow connector insert's central circular bore 25 tapers outward toward the bottom of the insert 24 and has a series of concentric ribs 27 extending normally from the side walls of the bore. The rib's diameters decrease in size traveling farther from the opening of the bore. The internal diameters of the various concentric ribs 27 are slightly smaller than the external diameters of the most common commercially available bottle necks.

The bidirectional flow connector insert 24 illustrated in FIGS. 11, 12 and 13, is for frictional connection to the bottle class of fluid vessels, although in an alternate embodiment a larger diameter insert 24 it is frictionally attachable to the class of fluid vessels including cans, glasses and jars.

In operation, a polymer straw 20 is frictionally inserted over or into the straw connector 18, depending on the outside and inside diameters of the straw selected. Then a fluid vessel with desired fluid is selected, the straw 20 is inserted into the fluid vessel such that its lower tip is immersed in the fluid, and the bidirectional flow connector insert 24 is frictionally engaged over the top of the fluid vessel. Generally, this will be accomplished by applying a downward force on the water pipe body 2 while rocking it such that the top of the fluid vessel is firmly seated in the smallest concentric ring 27 of the bidirectional flow connector insert 24. Ice chips 99 are placed in the lower half of the side chamber 40 of the water pipe body 2. The tapered bowl insert 16 is inserted into the upper chamber 38 until its tapered body frictionally engages the inner wall upper chamber 38 so that the fresh air induction port is blocked. The dry herb is packed into the bowl insert 16 and ignited while the user draws air in from the inhalation arm. Smoke is then drawn from the bottom orifice of the bowl insert, through the upper chamber 38, through the straw connector 18 (passing through the center of the bidirectional flow connector insert 24), into the straw 20 and bubbles out of the lower tip of the straw 20, enters the fluid vessel, is drawn up through the side vents 32 in the bidirectional flow connector insert 24, into the smoke return cavity 34, through the ice grate 71, through the interstitial voids around the ice chips 99, up the side chamber 40 and into the users lungs. During the completion of the final inhalation, the bowl insert 16 is partially raised from the upper cavity 38 so that the fresh air induction port is opened and a volumetric charge of fresh air will traverse the vessel and water pipe body to the user. Thereafter, the residual ashes may be dislodged from the bowl insert 16, the straw 20 removed and the remaining parts of the water pipe body 2 may be placed in a dishwasher for cleaning. As can be seen, the connection of the water pipe body 2 to a fluid vessel such as a beer bottle, forms an operative path through which smoke may be drawn from ignited organic material in the bowl insert to the inhalation arm outlet.

It is known that an optional bubbler tip may be inserted on the immersed end of the straw so as to separate and redirect the stream of incoming dry herb smoke entering the fluid vessel into several smaller bubble paths exiting the straw 20 at 90 degrees from the linear axis of the straw. This just adds a visual enhancement to the smoke disbursement into the fluid.

Figure 17:
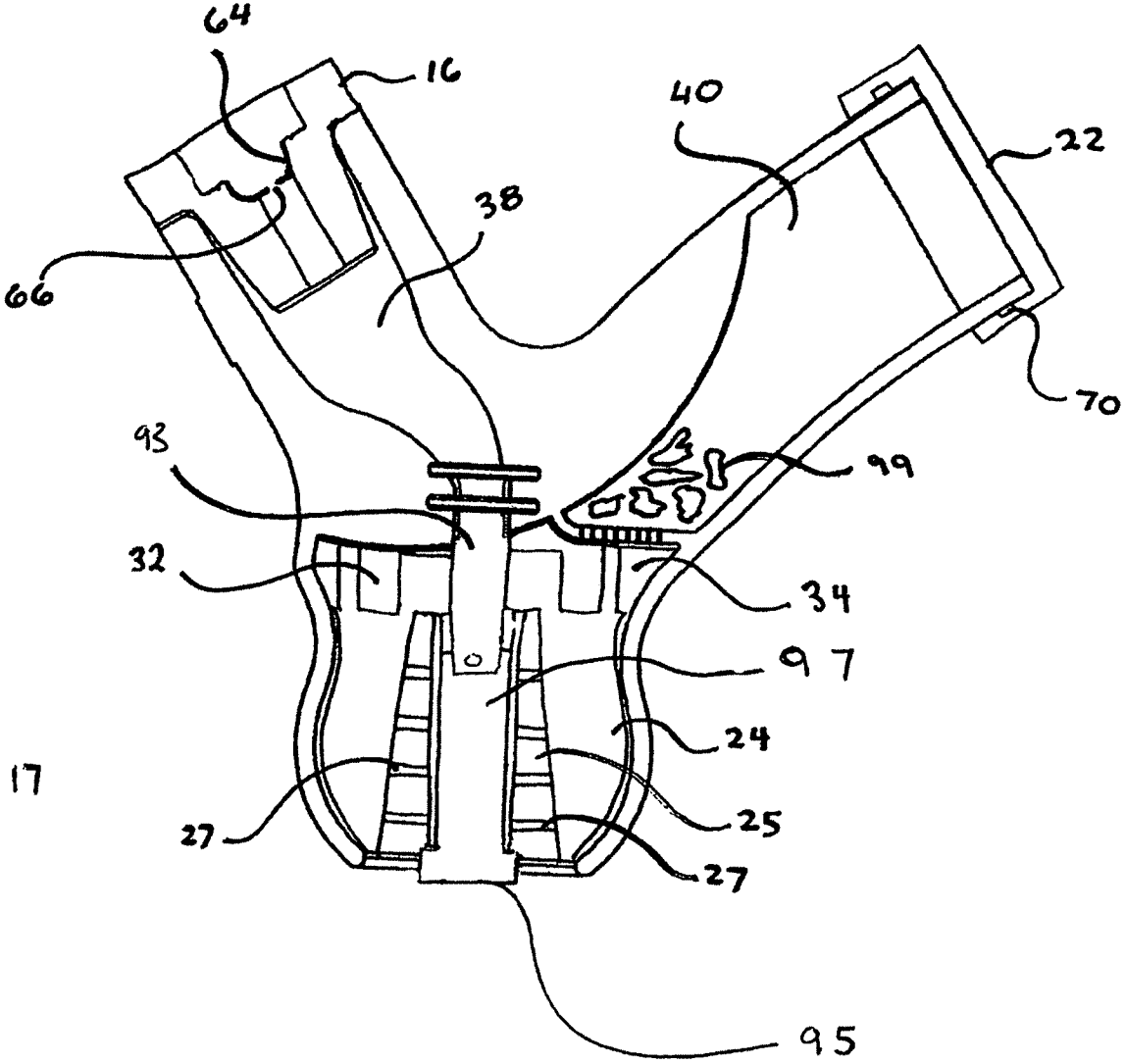
FIG. 17 is a side cross sectional view showing the plug is an assembled water pipe body.

Looking at FIG. 17, it can be seen that an option plug 95 may be inserted into the bottom end of the bidirectional flow connector insert 24 sealing the bidirectional flow connector insert 24 and the lower chamber 36 from the outside atmosphere. The plug 95 is a hollow cylinder open only at one end and sized for mating frictional engagement with the inner walls of the bidirectional flow connector insert 24. In this mode, called the dry plug mode organic matter may be smoked without the need for a coupling the device to a fluid vessel. Additionally, fluid 97 may be added to the plug 95 so as to reside at a level above the bottom of the an alternate straw connector 93 allow the device to function as a water pipe without the need to couple it to a separate fluid vessel. Thus as can be seen the water pipe body may be to operated in three modes, a vessel mode, a dry plug mode and a wet plug mode.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions in so far as they do not depart from the spirit and scope of the present invention.

The invention claimed is:

1. A portable water pipe body comprising:

a housing having an upper chamber, a lower chamber and a side chamber, said housing made from two mirror image halves;

a bowl insert, removably housed in said upper chamber;

a bidirectional flow connector insert housed in said lower chamber;

a straw connector affixed centrally in the housing and passing from said upper chamber through the center of the bidirectional flow connector insert in said lower chamber; and a straw affixed to said straw connector and exiting said housing from said lower chamber; and wherein the side chamber is operably connected to said lower chamber by an ice grate.

2. The water pipe body of claim 1 wherein said bidirectional flow connector insert has a central orifice that accommodates said straw connector and a series of radial side vents.

3. The water pipe body of claim 2 wherein said radial side vents exit into a smoke return cavity in the lower chamber.

4. The water pipe body of claim 3 wherein said smoke chamber is formed in the lower chamber between a seal formed at a perimeter of the bidirectional flow connector insert an inner wall of the lower chamber 36.

5. The water pipe body of claim 4 wherein said bidirectional flow connector insert has a central circular bore with a series of concentric ribs extending normally from a side wall thereof.

6. The water pipe body of claim 5 wherein said concentric ribs have an internal diameter, said internal diameters decrease in size farther from a bottom opening of said bore.

7. A portable water pipe body comprising:

a housing having an upper chamber, a lower chamber and a side chamber;

a bowl insert, removably housed in said upper chamber;

a bidirectional flow connector insert housed in said lower chamber;

a straw connector affixed centrally in the housing and passing from said upper chamber through the center of the bidirectional flow connector insert in said lower chamber; and a straw affixed to said straw connector and exiting said housing from said lower chamber; and wherein said bidirectional flow connector insert has a central circular bore with a series of concentric ribs extending normally from the side walls thereof for frictional engagement with a fluid vessel.

8. The water pipe body of claim 7 wherein said concentric ribs have an internal diameter, said internal diameters decrease in size farther from an opening of the bore.

9. A portable water pipe body for the inhalation of smoke comprising:

a housing having at least two chambers therein;

a bowl insert affixed in said housing, said bowl for the direction of smoke therefrom ignited organic material thereon;

a fluid vessel connector affixed in said housing wherein when said fluid vessel connector is connected to a fluid vessel with fluid therein, an operative path for the passage of said smoke through said bowl insert, said fluid vessel and said at least two chambers is formed; and wherein said fluid vessel connector has a central circular bore with a series of concentric ribs extending normally therefrom for frictional engagement with a fluid vessel.

10. The water pipe body of claim 9 wherein said concentric ribs have an internal diameter, said internal diameters decrease in size farther from a bottom opening of said bore.

* * * * *